US010736374B2

(12) United States Patent
An et al.

(10) Patent No.: US 10,736,374 B2
(45) Date of Patent: Aug. 11, 2020

(54) TYPE VARIABLE HELMET

(71) Applicant: KIDO SPORTS CO., LTD., Seoul (KR)

(72) Inventors: Jang Hun An, Seoul (KR); Geun Ho Jwa, Seoul (KR)

(73) Assignee: KIDO Sports Co., Ltd., Seoul (KR)

( * ) Notice: Subject to any disclaimer, the term of this patent is extended or adjusted under 35 U.S.C. 154(b) by 12 days.

(21) Appl. No.: 16/066,782

(22) PCT Filed: Mar. 21, 2016

(86) PCT No.: PCT/KR2016/002805
§ 371 (c)(1),
(2) Date: Jun. 28, 2018

(87) PCT Pub. No.: WO2017/159905
PCT Pub. Date: Sep. 21, 2017

(65) Prior Publication Data

US 2019/0014852 A1 Jan. 17, 2019

(30) Foreign Application Priority Data

Mar. 17, 2016 (KR) ..... 10-2016-0032263

(51) Int. Cl.

| | |
|---|---|
| ***A42B 3/32*** | (2006.01) |
| ***A42B 3/22*** | (2006.01) |
| ***A42B 3/20*** | (2006.01) |
| ***A42B 3/08*** | (2006.01) |
| *A42B 3/28* | (2006.01) |

(52) U.S. Cl.
CPC ..... *A42B 3/326* (2013.01); *A42B 3/08* (2013.01); *A42B 3/221* (2013.01); *A42B 3/20* (2013.01); *A42B 3/281* (2013.01)

(58) Field of Classification Search
CPC .. A42B 3/08; A42B 3/20; A42B 3/221; A42B 3/281; A42B 3/326
USPC ..... 2/424
See application file for complete search history.

(56) References Cited

U.S. PATENT DOCUMENTS

| | | | | |
|---|---|---|---|---|
| 4,024,587 | A | 5/1977 | Barford | |
| 2005/0278833 | A1* | 12/2005 | Pierce | A42B 3/281 2/424 |
| 2008/0189835 | A1* | 8/2008 | Mangone | A42B 3/324 2/420 |

(Continued)

FOREIGN PATENT DOCUMENTS

| | | | |
|---|---|---|---|
| CN | 2778019 | Y | 5/2006 |
| CN | 201831006 | U | 5/2011 |
| CN | 203262379 | U | 11/2013 |

(Continued)

OTHER PUBLICATIONS

Int'l Search Report dated Dec. 8, 2016 in Int'l Application No. PCT/KR2016/002805.

(Continued)

*Primary Examiner* — Katherine M Moran
(74) *Attorney, Agent, or Firm* — Panitch Schwarze Belisario & Nadel LLP

(57) ABSTRACT

A type variable helmet includes a half face unit formed to cover an upper part of a user's head, and an under face unit detachably attached to a lower part of the half face unit and configured to cover a lower part of the head of the user.

8 Claims, 13 Drawing Sheets

(56) References Cited

U.S. PATENT DOCUMENTS

| | | | | |
|---|---|---|---|---|
| 2014/0143937 | A1 | 5/2014 | Cram | |
| 2014/0338105 | A1* | 11/2014 | Maier | A42B 3/326 2/421 |

FOREIGN PATENT DOCUMENTS

| | | | |
|---|---|---|---|
| DE | 3214020 | A1 | 7/1983 |
| GB | 2451429 | A | 2/2009 |
| KR | 101185834 | B1 | 10/2012 |
| KR | 20140040677 | A | 4/2014 |

OTHER PUBLICATIONS

Extended European Search Report dated Sep. 10, 2019 in European Application No. 16894636.6.

* cited by examiner

TYPE VARIABLE HELMET

CROSS-REFERENCE TO RELATED APPLICATIONS

This application is a Section 371 of International Application No. PCT/KR2016/002805, filed Mar. 21, 2016, which was published in the Korean language on Sep. 21, 2017 under International Publication No. WO 2017/159905 A1, which claims priority under 35 U.S.C. § 119 to Korean Patent Application No. 10-2016-0032263, filed on Mar. 17, 2016; the disclosures of both are incorporated herein by reference.

TECHNICAL FIELD

The present disclosure relates to a helmet capable of protecting a head of a user, and more particularly, to a type variable helmet which can be changed into various forms.

BACKGROUND ART

Generally, helmets are worn to protect a head of a rider when the rider rides a motorcycle or the like, and it is provided that helmets be worn for safety when driving.

Helmets have a sufficient strength capable of withstanding impact applied from the outside without being damaged and thus serve to protect the head of a wearer, and absorb and mitigate the impact and thus serve to promote safety of the wearer.

Such helmets may be classified into a half face type, an open face type, a full face type, and the like in accordance with forms thereof.

The half face type helmet is formed to cover only an upper part of the head of a user, and has a characteristic that it is easy to carry due to a small volume, and is highly preferred by users due to being convenient to wear.

The open face type helmet is formed to cover an upper part of the head of the user and a side part and a rear part of a lower part of the head, and has the characteristic of a wide protective region in comparison to the half face type helmet.

The full face type helmet is formed to cover an entire region of the head of the user including the user's face, and has the characteristic of being somewhat inconvenient to wear in comparison to the half face type helmet and the open face type helmet despite having the widest protective region in comparison to the half face type helmet and the open face type helmet.

The above-described various forms of helmets are selectively used depending on timing and purpose in many cases, and, depending on users, all of the helmets are purchased and used in many cases.

However, in a conventional case, the user has to separately purchase all types of helmets described above to wear different helmets depending on purpose, which leads to problems of imposing a cost burden on the user and being difficult for the user to store the helmets.

Therefore, a method of solving such problems is required.

DISCLOSURE

Technical Problem

The present disclosure is directed to providing a type variable helmet which can be used by easily changing its form depending on purpose.

Objects of the present disclosure are not limited to those mentioned above, and other unmentioned objects should be clearly understood by those of ordinary skill in the art from the description below.

Technical Solution

One aspect of the present disclosure provides a type variable helmet including a half face unit formed to cover an upper region of a head of a user, and an under face unit detachably attached to a lower part of the half face unit and formed to cover a lower region of the head of the user.

The under face unit may include a first coupling module formed at a position corresponding to a temporal region of the head of the user, and a second coupling module formed at a position corresponding to an occipital region of the head of the user, and the half face unit may include a third coupling module formed to be coupled to and detached from the first coupling module, and a fourth coupling module formed to be coupled to and detached from the second coupling module.

The first coupling module may include a locking member formed in the form of a hook, and the third coupling module may be formed in the form of a groove to which the locking member is locked.

The second coupling module may include a shaft rotation member including a locking part formed in the form of a hook that protrudes toward an upper part of the under face unit, a manipulation part that protrudes toward a lower part of the under face unit, and a hinge part that is disposed between the locking part and the manipulation part and forms a rotating shaft, and the fourth coupling module may be formed in the form of a groove to which the locking part is locked.

The under face unit may include an occipital region cover part configured to cover an occipital region of the lower region of the head of the user, and a face cover part detachably attached to the occipital region cover part and configured to cover a face part of the lower region of the head of the user.

The occipital region cover part may include a fifth coupling module, and the face cover part may include a sixth coupling module formed to be coupled to and detached from the fifth coupling module.

The sixth coupling module may include a protruding part that protrudes toward the fifth coupling module, and the fifth coupling module may include an insertion part into which the protruding part is inserted.

The protruding part and the insertion part may be coupled to each other by magnetic force and a hook.

A vent through which air flows may be formed in the face cover part.

The type variable helmet may further include a mask member attached to an interior of the face cover part, with an auxiliary vent formed at a position misaligned with the vent.

Advantageous Effects

The type variable helmet of the present disclosure for achieving the above-mentioned objects has the following advantageous effects.

First, since the type variable helmet can be changed into various types of helmets by each part of the helmet being detached from and coupled to each other, there is an advantage in that the helmet can be changed into a desired type of helmet depending on its intended use and worn.

Second, since the type variable helmet can be changed into various types of helmets with only a cost of purchasing a single helmet, different forms of helmets do not have to be purchased separately, and there is an advantage in that a financial burden imposed on the user can be minimized.

Third, there is an advantage in that coupling and detaching each part to and from each other can be performed easily and conveniently.

Advantageous effects of the present disclosure are not limited to the above-mentioned advantageous effects, and other unmentioned advantageous effects should be clearly understood by those of ordinary skill in the art from the claims below.

MODES OF THE INVENTION

Figure 1:
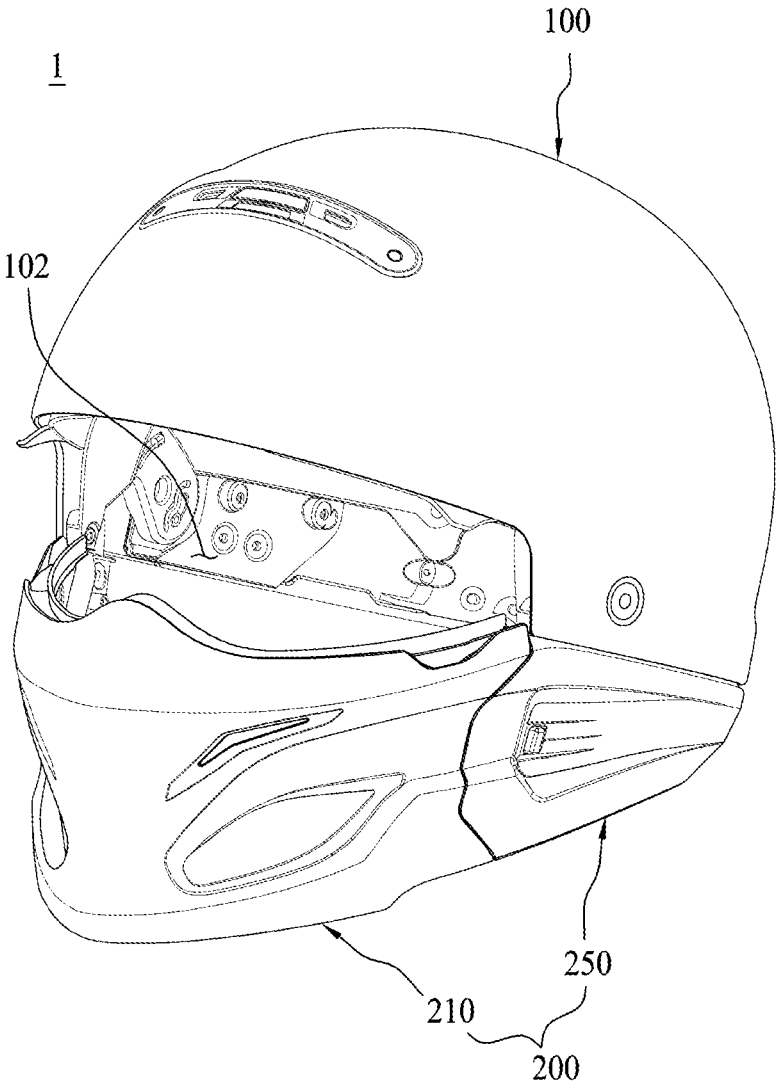
FIG. 1 is an overall view of a type variable helmet according to an embodiment of the present disclosure.

Hereinafter, exemplary embodiments of the present disclosure through which the objects of the present disclosure can be specifically realized will be described with reference to the accompanying drawings. In describing the present embodiment, the same names and the same reference numerals will be used for the same elements, and additional description according thereto will be omitted.

FIG. 1 is an overall view of a type variable helmet 1 according to an embodiment of the present disclosure.

As illustrated in FIG. 1, the type variable helmet 1 according to an embodiment of the present disclosure includes a half face unit 100 and an under face unit 200. In the present embodiment, the under face unit 200 includes an occipital region cover part 250 and a face cover part 210.

The helmet 1 illustrated in FIG. 1 has the form of a full face type helmet 1 in which all of the half face unit 100 and the under face unit 200 including the occipital region cover part 250 and the face cover part 210 are coupled.

The half face unit 100 is formed to cover an upper region of a head of a user, and the under face unit 200 and the half face unit 100 are formed to cover a lower region of the head of the user.

The half face unit 100 and the under face unit 200 may be detachably attached to each other, and the occipital region cover part 250 and the face cover part 210 of the under face unit 200 may also be detachably attached to each other.

The occipital region cover part 250 is an element formed to cover an occipital region of the lower region of the head of the user, and the face cover part 210 is an element configured to cover a face part of the lower region of the head of the user.

In the case of the present embodiment, the half face unit 100 is directly coupled to the occipital region cover part 250, and the face cover part 210 is disposed in front of the occipital region cover part 250 and is directly coupled to the occipital region cover part 250. In this case, an opening 102 is formed between the half face unit 100 and the face cover part 210. The opening 102 is formed in the form corresponding to a sun visor rotatably mounted on the half face unit 100, and accordingly, in a case where the sun visor is lowered, the opening 102 is blocked by the sun visor.

Accordingly, in the present disclosure, each part of the helmet 1 may be detached from and coupled to each other, and hereinafter, first, a coupling structure between the face cover part 210 and the occipital region cover part 250 will be described.

Figure 2:
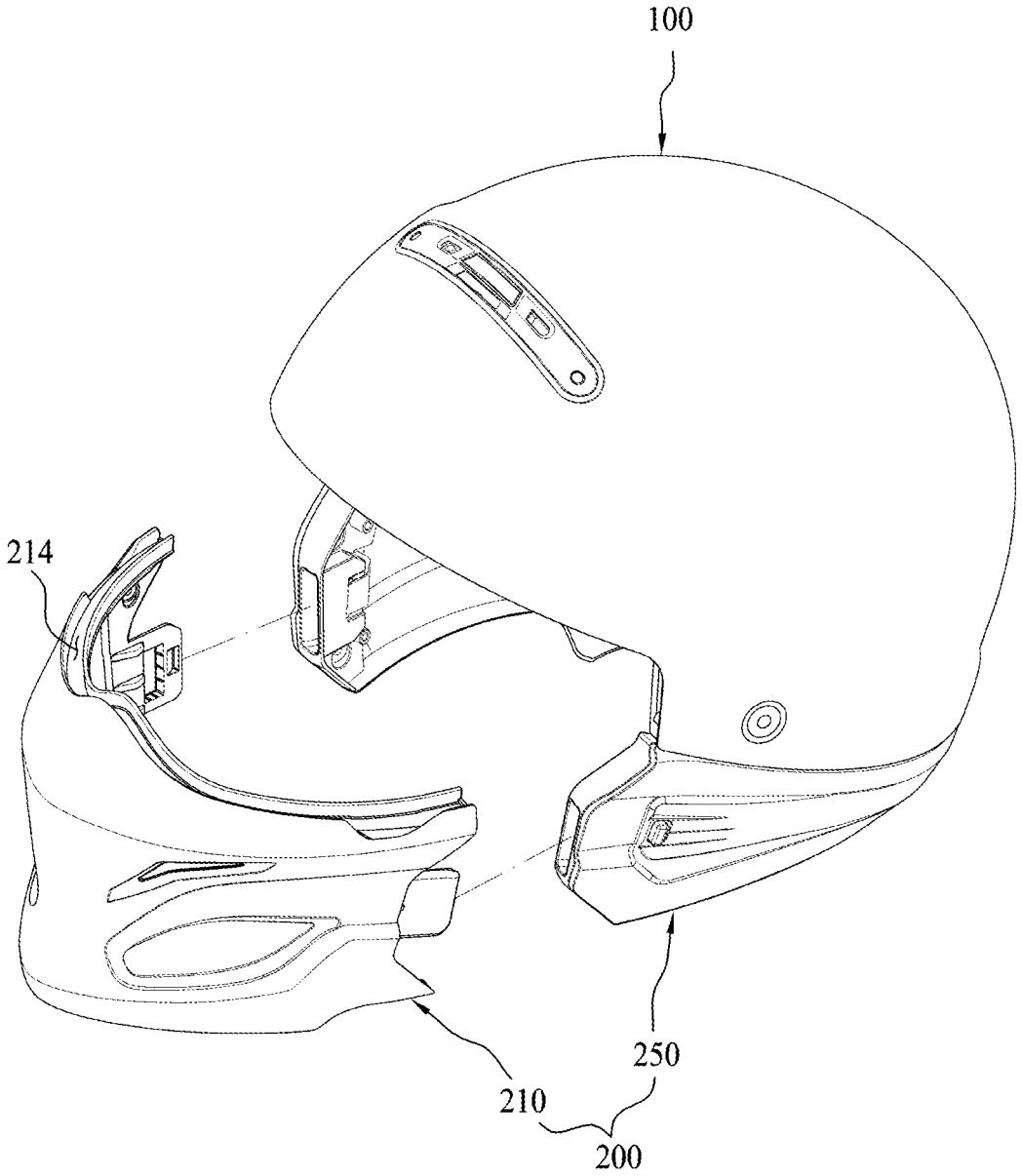
FIG. 2 is a view illustrating a state in which, in a type variable helmet according to an embodiment of the present disclosure, a face cover part is detached from an occipital region cover part.
Figure 3:
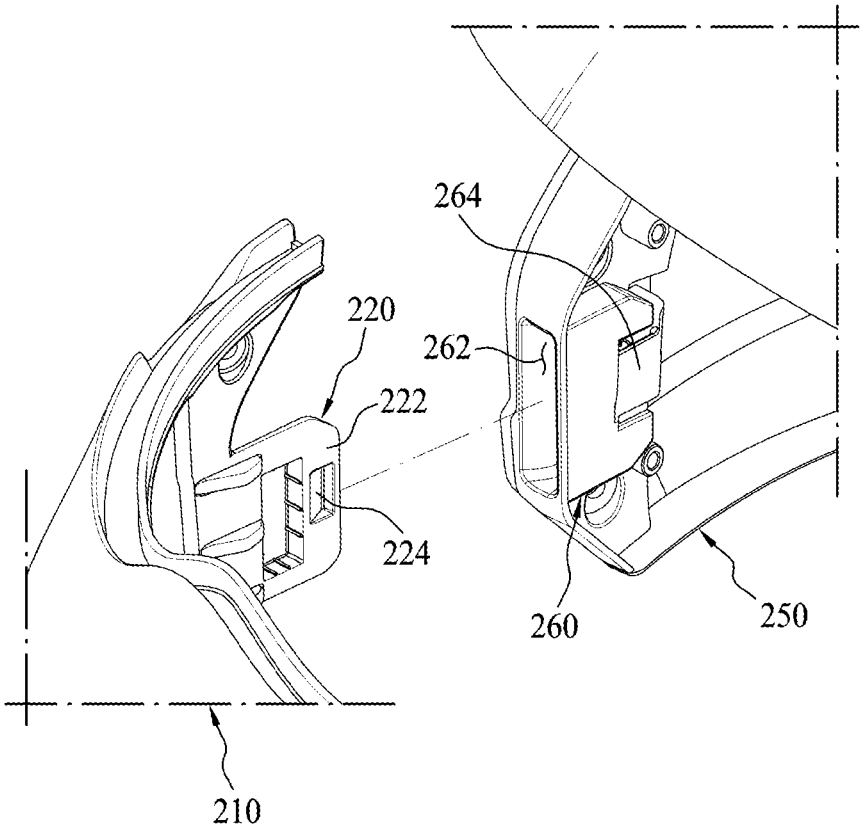
FIGS. 3 and 4 are views illustrating a coupling structure between a face cover part and an occipital region cover part in a type variable helmet according to an embodiment of the present disclosure.
Figure 4:
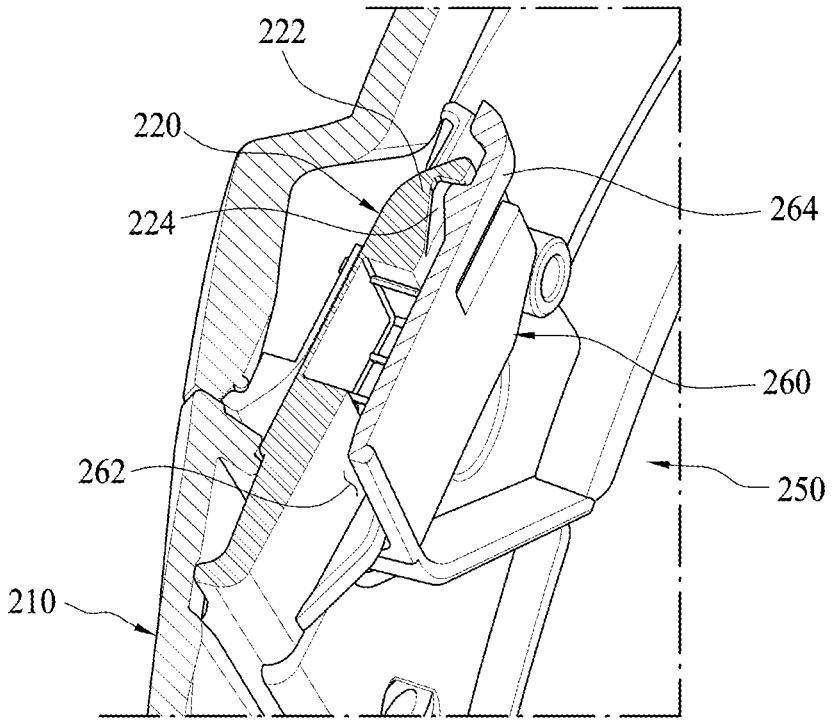

FIG. 2 is a view illustrating a state in which, in a type variable helmet according to an embodiment of the present disclosure, a face cover part 210 is detached from an occipital region cover part 250, and FIGS. 3 and 4 are views illustrating a coupling structure between the face cover part 210 and the occipital region cover part 250 in the type variable helmet according to an embodiment of the present disclosure.

As illustrated in FIGS. 2 to 4, in the present embodiment, the face cover part 210 is formed to be detachable from a front side of the occipital region cover part 250, and in such a state in which the face cover part 210 is detached, the type variable helmet can be changed into an open face type helmet.

In this case, a sixth coupling module 220 is disposed at both sides of the face cover part 210, and a fifth coupling module 260 is disposed at both sides of the occipital region cover part 250.

Specifically, in the case of the present embodiment, the sixth coupling module 220 includes a protruding part 222 that protrudes toward the fifth coupling module 260, and the fifth coupling module 260 includes an insertion part 262 into which the protruding part 222 is inserted. That is, in the present embodiment, the protruding part 222 of the face cover part 210 is inserted into the insertion part 262 of the occipital region cover part 250 for the protruding part 222 and the insertion part 262 to be coupled to each other.

In this case, for stable fixing, the protruding part 222 and the insertion part 262 may be coupled to each other by magnetic force and a hook as illustrated in FIG. 4. The fixing serves to facilitate coupling between the protruding part 222 and the insertion part 262, and in the case of the present embodiment, a magnet 264 is disposed inside the insertion part 262, and a magnetic body 224 capable of being attached to the magnet 264 of the insertion part 262 is disposed at the protruding part 222. However, embodiments are not limited to the form of the present embodiment, and the magnet 264 and the magnetic body 224 may also be formed conversely from the above.

A sun visor insertion groove 214 into which a lower part of a sun visor may be inserted may be formed at an upper end of the face cover part 210. That is, in a case where the sun visor disposed in the half face unit 100 is lowered while the face cover part 210 is coupled to the occipital region cover part 250, the face cover part 210 may stably support the sun visor.

Figure 5:
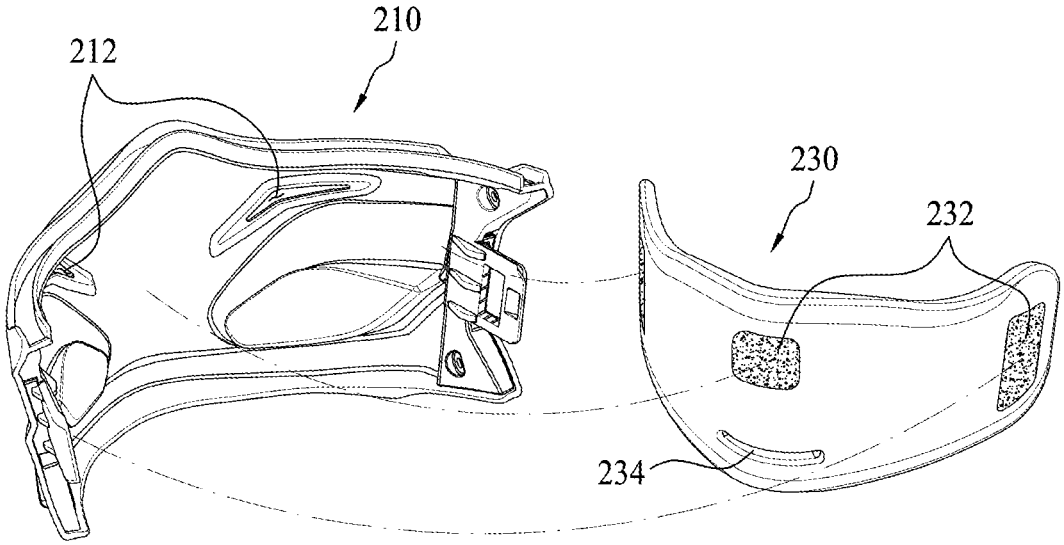
FIG. 5 is a view illustrating a state in which, in a type variable helmet according to an embodiment of the present disclosure, a mask member is mounted on a face cover part.

FIG. 5 is a view illustrating a state in which, in a type variable helmet according to an embodiment of the present disclosure, a mask member 230 is mounted on a face cover part 210.

As illustrated in FIG. 5, in the case of the present embodiment, the type variable helmet may further include the mask member 230 attached to an interior of the face cover part 210. The mask member 230 may be formed of cloth or the like, to improve wear sensation of a user and to provide an impact-mitigating function.

The mask member 230 may be attached to the face cover part 210 in various ways, and in the present embodiment, Velcro 232 is formed at the mask member 230, and the mask member 230 is attached to the interior of the face cover part 210. In this case, although not illustrated, a Velcro corresponding part having a form corresponding to the Velcro 232 of the mask member 230 for the Velcro 232 to be attached thereto may be disposed at an inner surface of the face cover part 210.

In the case of the present embodiment, a vent 212 through which air flows is formed in the face cover part 210, and the vent 212 serves to smoothly supply air needed for respiration of a user. An auxiliary vent 234 formed at a position misaligned from the vent 212 may be formed in the mask member 230.

The reason that the auxiliary vent 234 is formed at a position misaligned from the vent 212 is to prevent air introduced from the outside from being directly transferred to a face of the user at high speed. That is, air introduced through the vent 212 may be introduced via the auxiliary vent 234.

Figure 6:
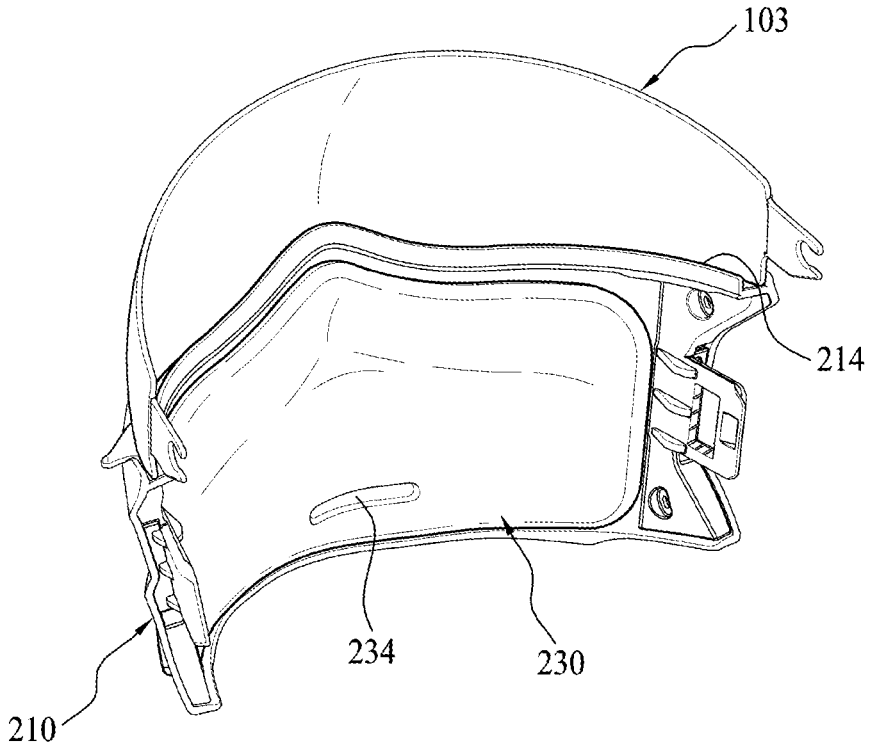
FIG. 6 is a view illustrating a state in which, in a type variable helmet according to an embodiment of the present disclosure, a mask member and a sun visor are mounted on a face cover part.

FIG. 6 illustrates a state in which, as described above, the mask member 230 is attached to the face cover part 210, and a state in which the vent 212 of the face cover part 210 is covered may be seen.

As illustrated in FIG. 6, in a case where a sun visor 103 rotatably disposed in a half face unit 100 is lowered, a lower end part of the sun visor 103 may be inserted into a sun visor insertion groove 214 of the face cover part 210.

The coupling structure of the face cover part 210 has been described above, and hereinafter, a coupling structure between the occipital region cover part 250 and the half face unit 100 will be described.

Figure 7:
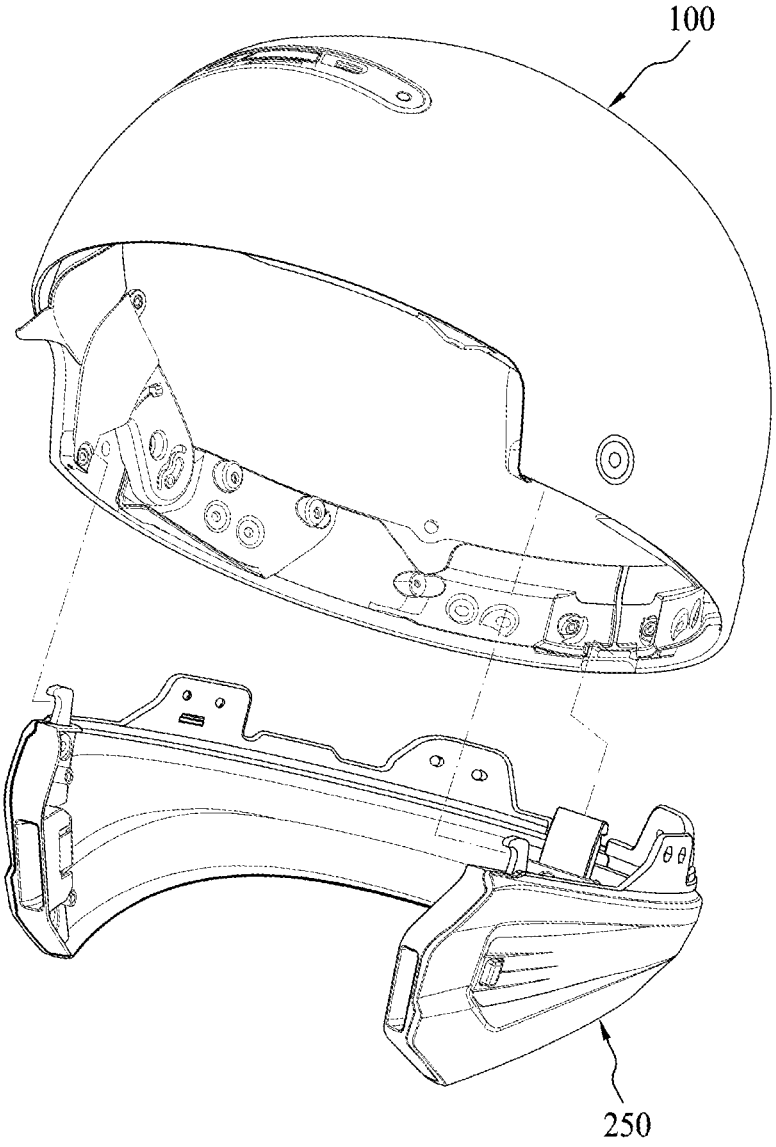
FIG. 7 is a view illustrating a state in which, in a type variable helmet according to an embodiment of the present disclosure, an occipital region cover part is detached from a half face unit.

FIG. 7 is a view illustrating a state in which, in a type variable helmet according to an embodiment of the present disclosure, an occipital region cover part 250 is detached from a half face unit 100.

As illustrated in FIG. 7, in the present embodiment, the occipital region cover part 250 is formed to be detachable from a lower side of the half face unit 100, and in such a state in which the occipital region cover part 250 is detached, the type variable helmet can be changed into a half face type helmet.

Figure 8:
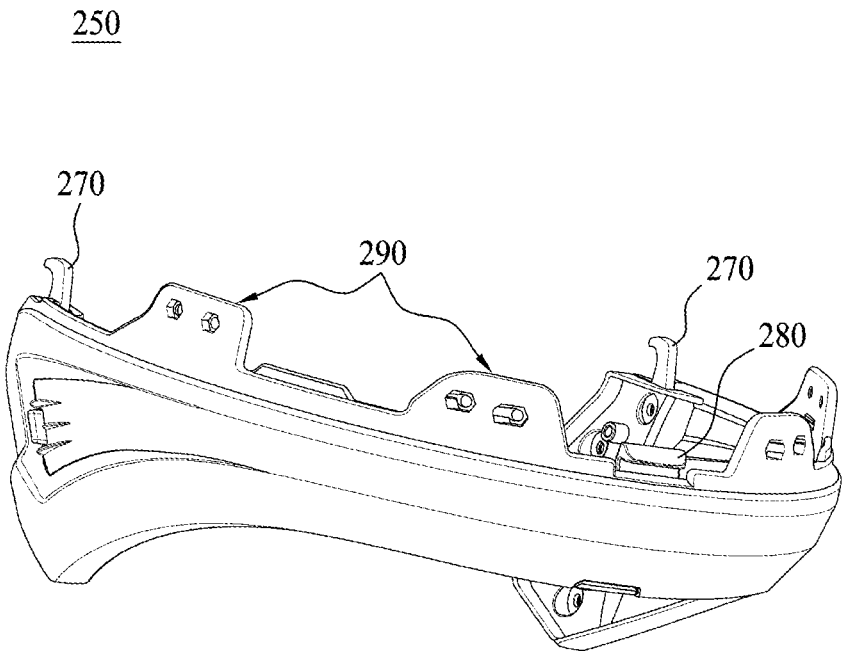
FIG. 8 is a view illustrating a state of an occipital region cover part in a type variable helmet according to an embodiment of the present disclosure.

In FIG. 8, a structure of the occipital region cover part 250 is illustrated.

As illustrated in FIG. 8, the occipital region cover part 250 is formed in a form to cover starting from a temporal region to an occipital region of a user, and includes a first coupling module 270 formed at a position corresponding to the temporal region of the user, a second coupling module 280 formed at a position corresponding to the occipital region of the user, and a seventh coupling module 290 formed between the first coupling module 270 and the second coupling module 280.

As illustrated in FIGS. 9 to 12, the first coupling module 270, the second coupling module 280, and the seventh coupling module 290 may be respectively coupled to or detached from a third coupling module 110, a fourth coupling module 120, and an eighth coupling module 130 of the half face unit 100.

Figure 9:
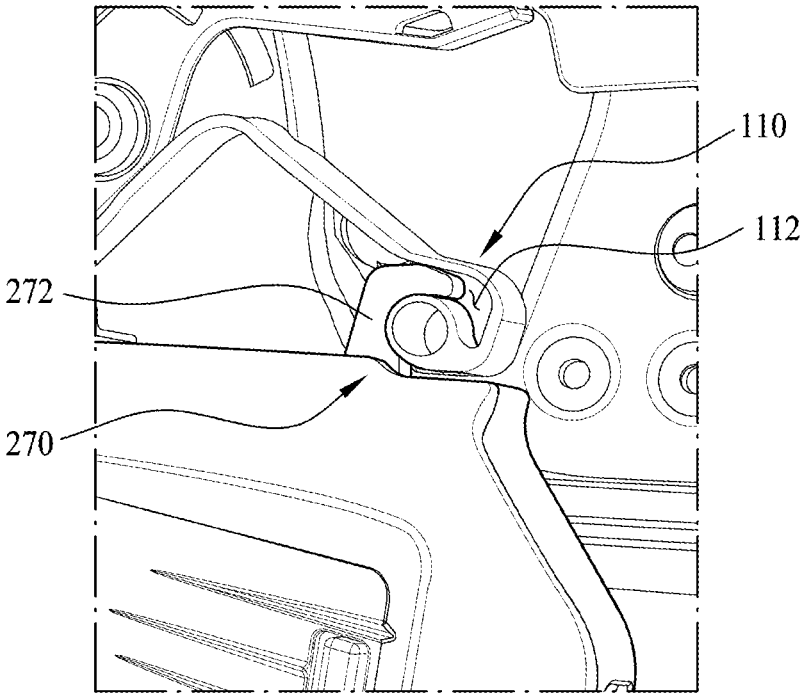
FIG. 9 is a view illustrating a coupling structure between a first coupling module of an occipital region cover part and a third coupling module of a half face unit in a type variable helmet according to an embodiment of the present disclosure.

As illustrated in FIG. 9, the first coupling module 270 includes a locking member 272 formed in a form of a hook, and the third coupling module 110 is formed in the form of a groove 112 to which the locking member 270 is locked. That is, for coupling between the half face unit 100 and the occipital region cover part 250, first, the locking member 272 of the first coupling module 270 is inserted into the groove 112 of the third coupling module 110 to be locked thereto.

Figure 10:
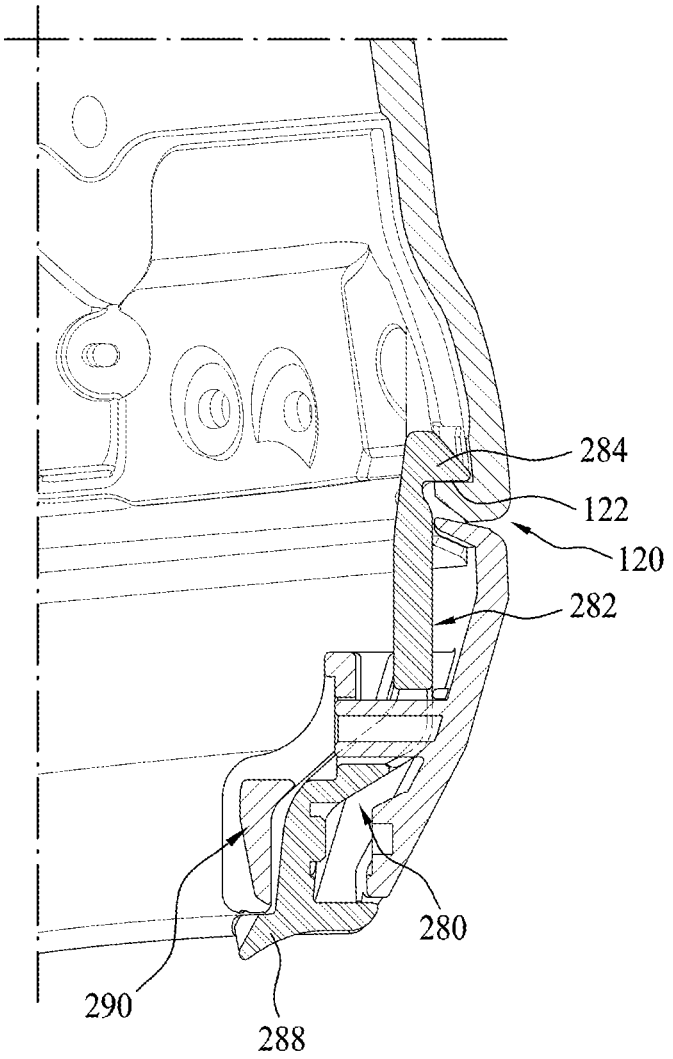
FIG. 10 is a view illustrating a coupling structure between a second coupling module of an occipital region cover part and a fourth coupling module of a half face unit in a type variable helmet according to an embodiment of the present disclosure.

In such a state, to completely fix the occipital region cover part 250 to the half face unit 100, the second coupling module 280 and the fourth coupling module 120 are coupled to each other as illustrated in FIG. 10.

Figure 11:
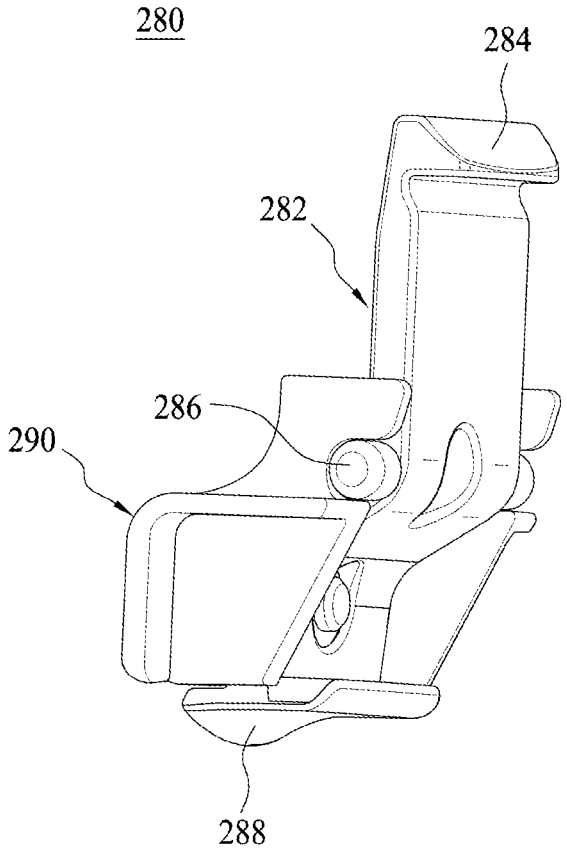
FIG. 11 is a view illustrating a structure of a second coupling module of an occipital region cover part in a type variable helmet according to an embodiment of the present disclosure in detail.

The second coupling module 280 includes a shaft rotation member 282 as illustrated in FIGS. 10 and 11. The shaft rotation member 282 includes a locking part 284 that protrudes toward an upper part of the occipital region cover part 250 and formed in the form of a hook, a manipulation part 288 that protrudes toward a lower part of the occipital region cover part 250, and a hinge part 282 that is disposed between the locking part 284 and the manipulation part 288 and forms a rotating shaft.

In this case, in the present embodiment, the occipital region cover part 260 includes a support member 292 configured to rotatably support the hinge part 282, and accordingly, the shaft rotation member 282 may be rotated by a predetermined angle about the hinge part 282.

Therefore, for coupling between the half face unit 100 and the occipital region cover part 250, while the locking member 272 of the first coupling module 270 is inserted into the groove 112 of the third coupling module 110 to be coupled thereto as described above, the manipulation part 288 of the shaft rotation member 282 is pressed to make the locking part 284 move backward, the occipital region cover part 250 is adhered to the half face unit 100, and then a pressure applied to the manipulation part 288 is released for the locking part 284 to be locked to a groove 122 of the fourth coupling module 120.

Accordingly, the half face unit 100 and the occipital region cover part 250 may be stably coupled to each other.

Figure 12:
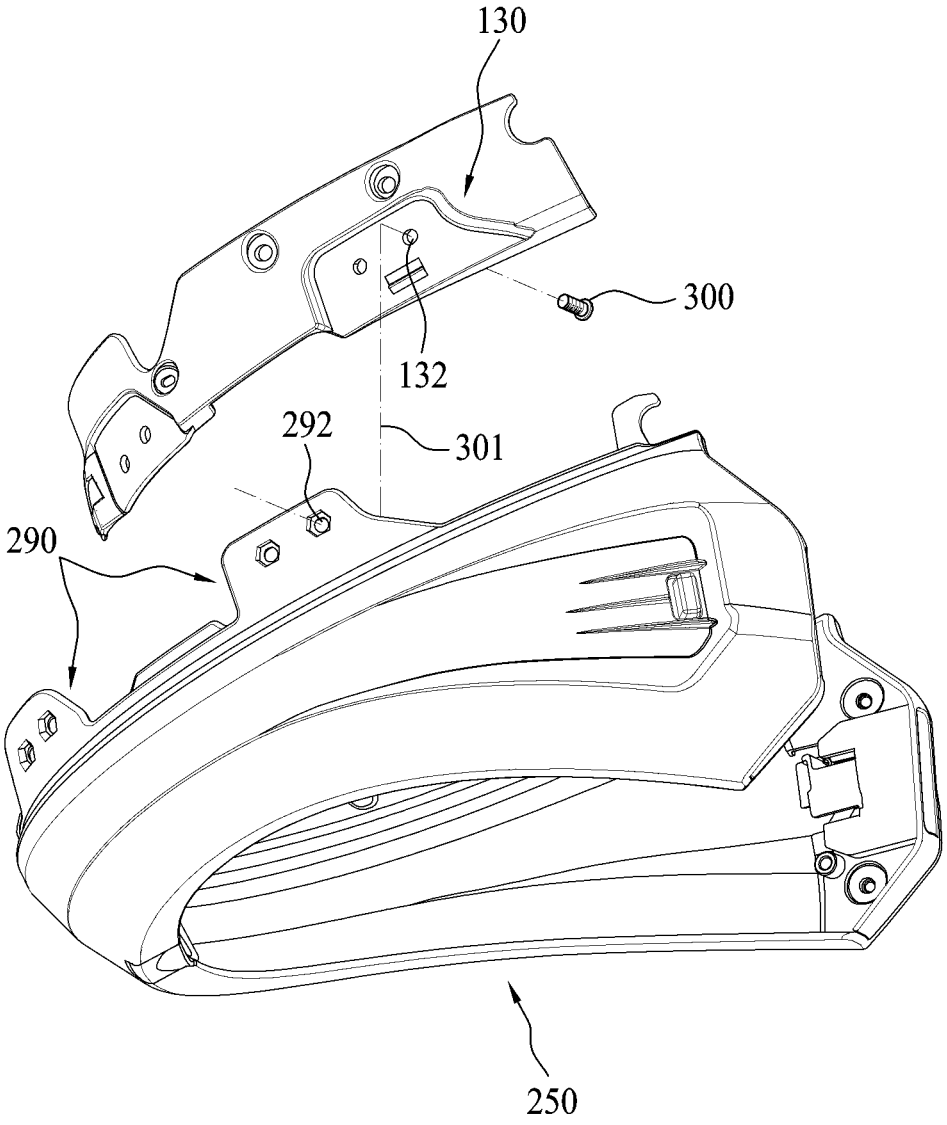
FIG. 12 is a view illustrating a coupling structure between a seventh coupling module of an occipital region cover part and an eighth coupling module of a half face unit in a type variable helmet according to an embodiment of the present disclosure.

FIG. 12 is a view illustrating a coupling structure between a seventh coupling module 290 of an occipital region cover part 250 and an eighth coupling module 130 of a half face unit 100 in a type variable helmet according to an embodiment of the present disclosure.

The seventh coupling module 290 and the eighth coupling module 130 serve to completely fix the half face unit 100 and the occipital region cover part 250 to each other to prevent the half face unit 100 and the occipital region cover part 250 from being detached from each other.

Since, depending on the country, there are places where the use of the half-face type helmet is not allowed, in corresponding countries, the type variable helmet is shipped in a state in which the seventh coupling module 290 and the eighth coupling module 130 are completely fastened to each other to satisfy such regulations.

For this, in the present embodiment, the seventh coupling module 290 has a form that protrudes upward, and the eighth coupling module 130 has a recessed form for the seventh coupling module 290 to be seated thereon. Also, fastening holes 132 and 292 corresponding to each other may be respectively formed at the seventh coupling module 290 and the eighth coupling module 130, and the fastening holes 132 and 292 may be fastened to each other by a fastening member 300, such as a bolt, along centerline 301 (see FIG. 12).

In such a case, the half face unit 100 and the occipital region cover part 250 are completely coupled to each other so as not to be detached from each other.

However, in countries without the above-mentioned regulations, the seventh coupling module 290 and the eighth coupling module 130 are maintained in a non-fastened state, and in such a case, a user may easily detach the half face unit 100 and the occipital region cover part 250 from each other.

Figure 13:
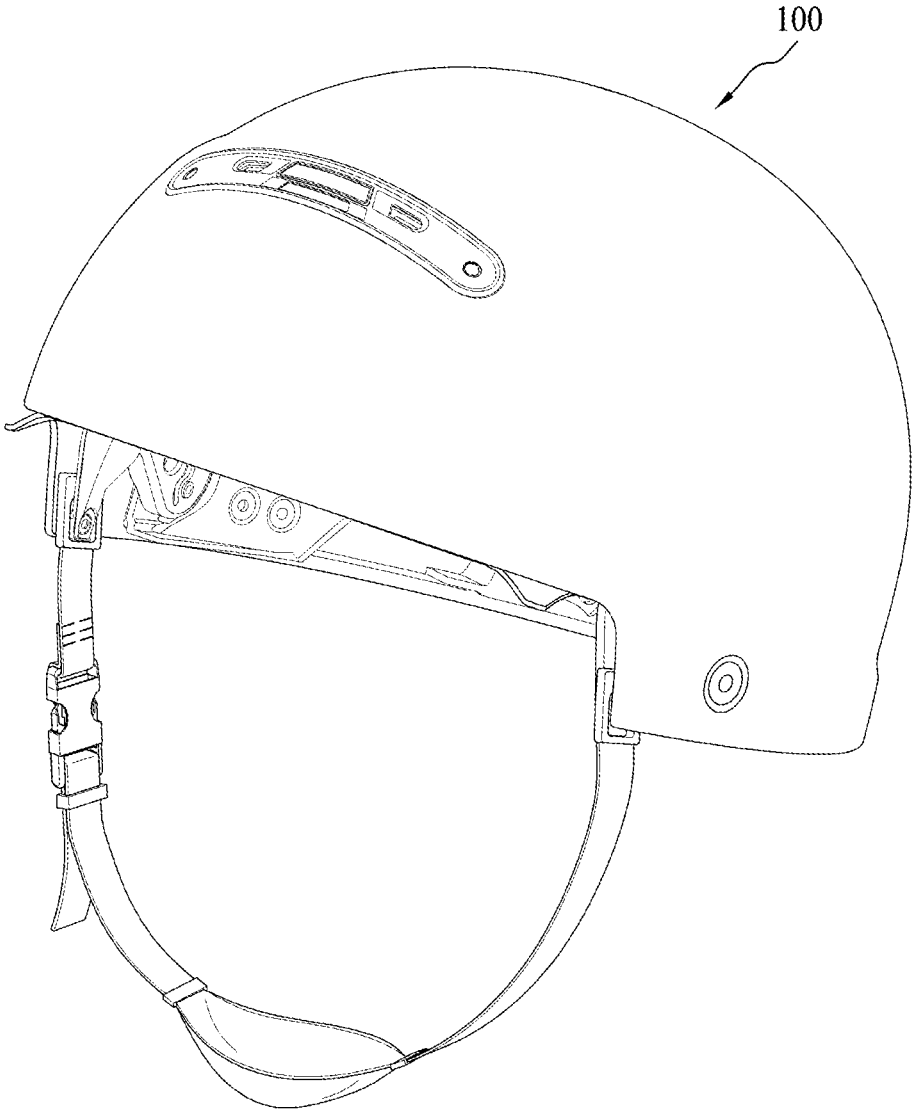
FIG. 13 is a view illustrating a state of a half face unit in a type variable helmet according to an embodiment of the present disclosure.

In a case where the occipital region cover part 250 is detached from the half face unit 100, as illustrated in FIG. 13, the type variable helmet may also be used as a half face type helmet. In this case, a chin strap configured to cover a wearer's chin to fix the helmet may be disposed in the half face unit 100.

Exemplary embodiments according to the present disclosure have been described above, and it is self-evident to those of ordinary skill in the art that, in addition to the above-described embodiments, the present disclosure may be embodied in other specific forms without departing from the gist or scope thereof Thus, the above-described embodiments should be considered as illustrative instead of limitative, and accordingly, the present disclosure is not limited to the above description and may be modified within the scope of the attached claims and their equivalents.

The invention claimed is:

1. A type variable helmet comprising:

a half face unit formed to cover an upper region of a head of a user; and an under face unit detachably attached to a lower part of the half face unit and formed to cover a lower region of the head of the user, wherein:

the under face unit includes a first coupling module formed at a position corresponding to a temporal region of the head of the user, and a second coupling module formed at a position corresponding to an occipital region of the head of the user;

the half face unit includes a third coupling module formed to be coupled to and detached from the first coupling module, and a fourth coupling module formed to be coupled to and detached from the second coupling module;

the second coupling module includes a shaft rotation member including:

a locking part formed in the form of a hook that protrudes toward an upper part of the under face unit, a manipulation part that protrudes toward a lower part of the under face unit, and a hinge part that is disposed between the locking part and the manipulation part and forms a rotating shaft and the fourth coupling module is formed in the form of a groove to which the locking part is locked.

2. The type variable helmet of claim 1, wherein:

the first coupling module includes a locking member formed in the form of a hook; and the third coupling module is formed in the form of a groove to which the locking member is locked.

3. The type variable helmet of claim 1, wherein the under face unit includes:

an occipital region cover part configured to cover the occipital region of the lower region of the head of the user; and a face cover part detachably attached to the occipital region cover part and configured to cover a face part of the lower region of the head of the user.

4. The type variable helmet of claim 3, wherein:

the occipital region cover part includes a fifth coupling module; and the face cover part includes a sixth coupling module formed to be coupled to and detached from the fifth coupling module.

5. The type variable helmet of claim 4, wherein:

the sixth coupling module includes a protruding part that protrudes toward the fifth coupling module; and the fifth coupling module includes an insertion part into which the protruding part is inserted.

6. The type variable helmet of claim 5, wherein the insertion part includes an internal magnet and the protruding part includes a magnetic body, the insertion part and the protruding part being coupled to each other by a magnetic force between the magnet and the magnetic body and by a complementary hooked engagement.

7. The type variable helmet of claim 3, wherein a vent through which air flows is formed in the face cover part.

8. The type variable helmet of claim 7, further comprising a mask member attached to an interior of the face cover part, with an auxiliary vent formed at a position misaligned with the vent.

* * * * *